US011103396B1

(12) United States Patent
Groethe

(10) Patent No.: US 11,103,396 B1
(45) Date of Patent: Aug. 31, 2021

(54) PORTABLE CLEANING STATION FOR PHYSICALLY DISABLED PATIENTS

(71) Applicant: Christine Groethe, Edgewater, CO (US)

(72) Inventor: Christine Groethe, Edgewater, CO (US)

( * ) Notice: Subject to any disclaimer, the term of this patent is extended or adjusted under 35 U.S.C. 154(b) by 0 days.

(21) Appl. No.: 16/924,756

(22) Filed: Jul. 9, 2020

(51) Int. Cl.
*A61G 7/005* (2006.01)
*A61G 7/00* (2006.01)

(52) U.S. Cl.
CPC ..... *A61G 7/0005* (2013.01)

(58) Field of Classification Search
CPC ..... A61G 7/0005; A61G 1/04; A61G 1/044
See application file for complete search history.

(56) References Cited

U.S. PATENT DOCUMENTS 3,800,336 A 4/1974 Hoxeng
5,025,515 A 6/1991 Rhines
6,434,761 B1 8/2002 Wing et al.
2003/0131855 A1* 7/2003 Carter ..... A61F 5/37 128/870
2006/0042015 A1* 3/2006 Wang ..... A61G 7/1021 5/713
2006/0282944 A1 12/2006 Sagi
2014/0310875 A1* 10/2014 Iida ..... A61G 7/015 5/606

FOREIGN PATENT DOCUMENTS

CN 201676116 U 12/2010
RU 2342112 C1 10/2008

* cited by examiner

*Primary Examiner* — Janie M Loeppke

(57) ABSTRACT

A portable cleaning station for physically disabled patients includes a platform. a handheld bidet system, at least one pair of head supports, at least one pair of hip supports, a left heel support, and a right heel support. The platform includes a curved body and a basin, wherein the basin is integrated into the curved body. The handheld bidet system is connected into the curved body and adjacently positioned to a bottom edge of the curved body so that the bidet system can be used for cleanliness activities of the patient. The pair of head supports is adjustably mounted to a top edge the curved body to support a patient's head. The pair of hip supports is adjustably mounted to the curved body to supports patient's body. The left heel support and the right heel support are adjustably mounted to the curved body to support patient's legs.

8 Claims, 6 Drawing Sheets

PORTABLE CLEANING STATION FOR PHYSICALLY DISABLED PATIENTS

FIELD OF THE INVENTION

The present invention relates generally to medical stretcher. More specifically, the present invention is a portable cleaning station for physically disabled patients so that the caregivers can properly conduct a bed bath.

BACKGROUND OF THE INVENTION

Providing caregivers with a safe and discreet way to administer personal hygiene to their patients is vital for both the caregiver and the patient. Keeping the patient clean is important in combating illness and maintaining their self-esteem, while the ability to accomplish this task with safe, quick, and easy facilitation is beneficial for the caregiver, while also maintaining the comfort of the patient. A patient who is bedridden may often find it difficult to maintain their personal hygiene standards by themselves and will, therefore, require the assistance of a caregiver. Generally, a patient is given bed bath or placed within a shower gurney, a shower stall, or a bathtub. However, a bed bath can sometime be limiting as the bed bath is not able to provide proper cleanliness to the patient. The options of a shower gurney, a shower stall, or a bathtub can sometime be difficult and/or unsafe for some patient due to their lack of mobility or may require multiple caregivers.

It is an objective of the present invention to provide a portable cleaning station for physically disabled patients. The present invention is a portable platform that is integrated with a basin and a handheld water nozzle. The present invention is specifically geared towards cleaning ischial, sacrum, and perineal areas. The present invention also secures the patient to the portable platform so that the caregivers can safely and efficiently conduct a bed bath for the physically disabled patients.

DETAIL DESCRIPTIONS OF THE INVENTION

All illustrations of the drawings are for the purpose of describing selected versions of the present invention and are not intended to limit the scope of the present invention.

Figure 1:
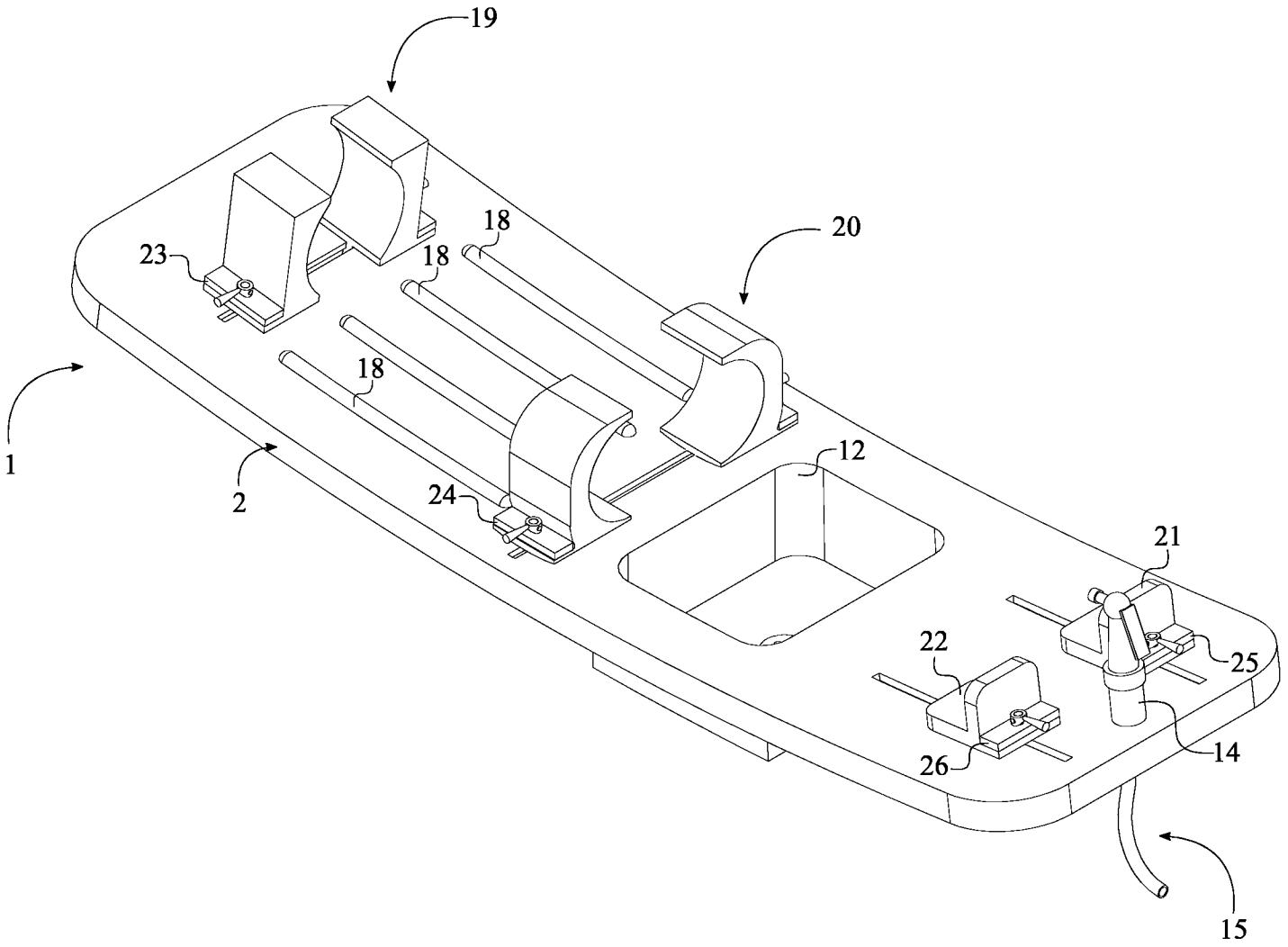
FIG. 1 is a top perspective view of the present invention.

The present invention is a portable cleaning station for physically disabled patients so that the caregivers can safely and efficiently conduct a bed bath for the patients. The present invention provides an upgrade over existing cleaning features such as a shower gurney, a shower stall, or a bathtub. The present invention comprises a platform 1, a handheld bidet system 15, at least one pair of head supports 19, at least one pair of hip supports 20, a left heel support 21, and a right heel support 22 as shown in FIG. 1.

In reference to the general configuration of the present invention, the platform 1 provides a stable and sufficient surface area to place the patient within and comprises a curved body 2 and a basin 12. More specifically, the basin 12 that provides drainage for graywater is integrated into the curved body 2 as the patient is placed on top of the curved body 2. The handheld bidet system 15 is connected into the curved body 2 so that the caregiver can easily access the handheld bidet system 15 to discharge clean water and clean the patient. Furthermore, the handheld bidet system 15 is adjacently positioned to a bottom edge 11 of the curved body 2 so that the handheld bidet system 15 can be operated without tangling around the patient's body. The left heel support 21 is adjustably mounted along the curved body 2 to rest patient's left foot. The right heel support 22 is adjustably mounted along the curved body 2 to rest patient's right foot. The pair of head supports 19 is adjustably mounted across the curved body 2 and adjacently positioned to a top edge 10 of the curved body 2 so that the patient's head can be stabilized during the bed bath. The pair of hip supports 20 is adjustably mounted across the curved body 2 and positioned adjacent to the basin 12 thus securing the hips of the patient to the curved body 2.

Figure 2:
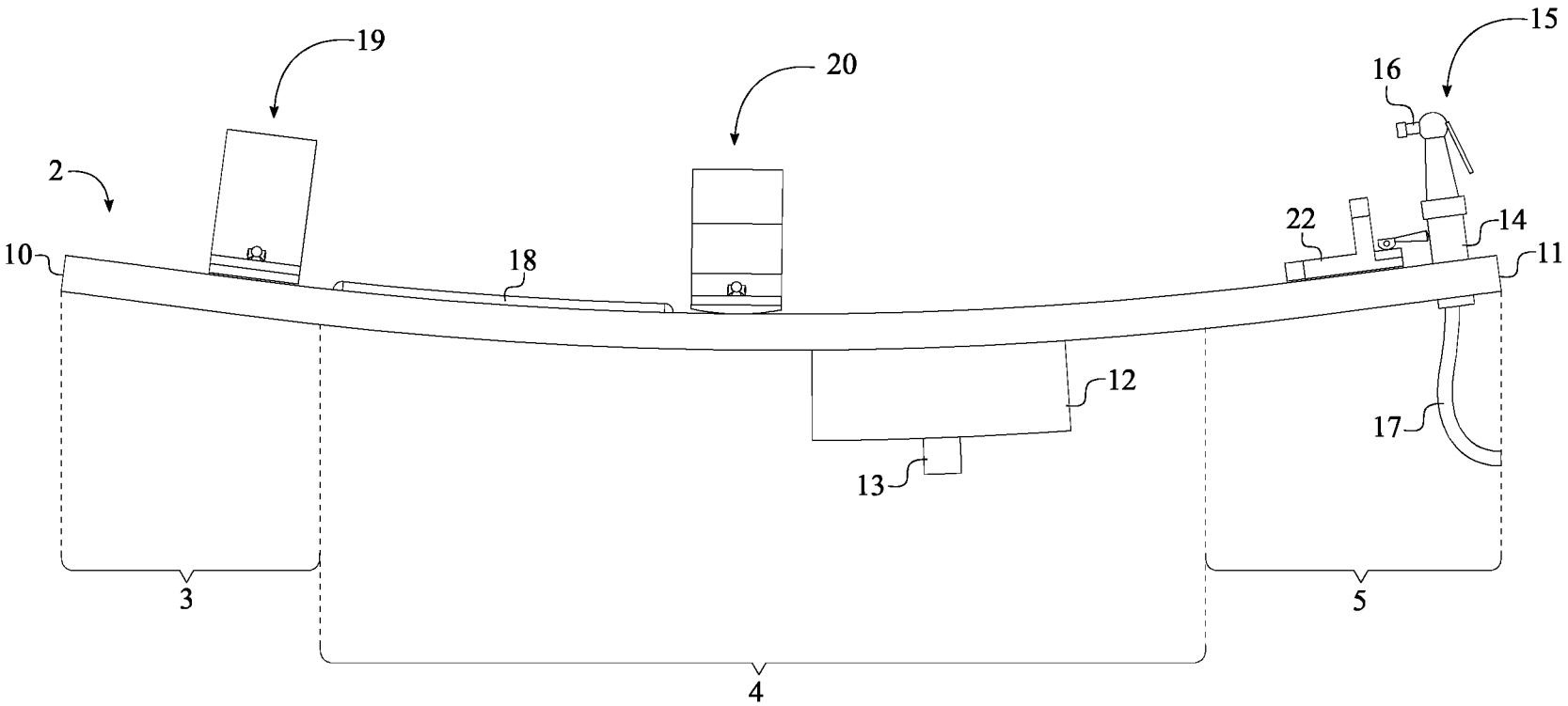
FIG. 2 is a right side view of the present invention.
Figure 3:
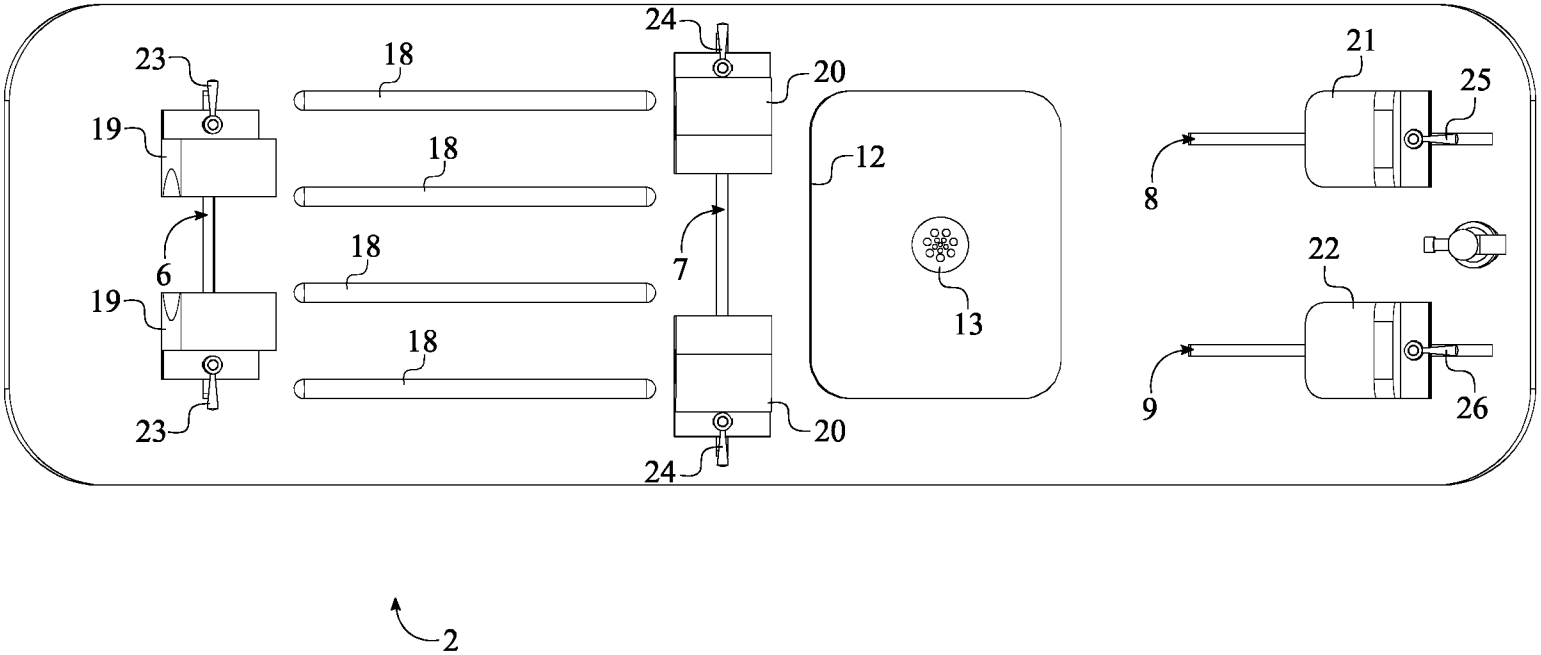
FIG. 3 is a top view of the present invention.
Figure 4:
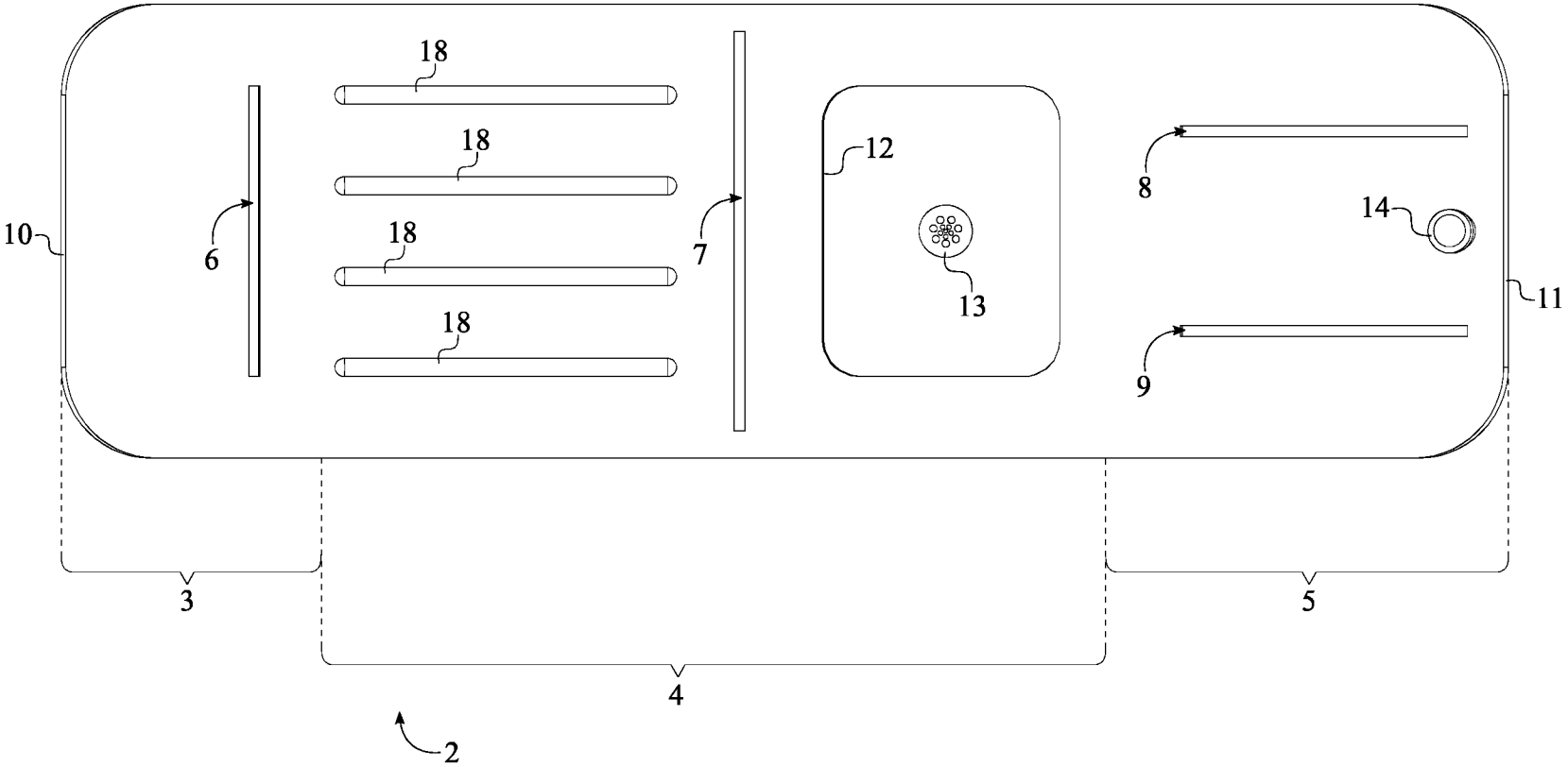
FIG. 4 is a top view of the platform of the present invention.

In reference to FIG. 2-4, the curved body 2 comprises a head section 3, a torso section 4, and a leg section 5. The exact curvature of the curved body 2 is determined in order to fully drain graywater towards the basin 12 and to provide optimal comfort to the patient. More specifically, the head section 3 and the torso section 4 are adjacently connected to each other. The leg section 5 is adjacently connected to the torso section 4 and positioned opposite of the head section 3. In other words, the head section 3 is an upper section of the curved body 2 and allows the patient to rest their head. The torso section 4 is a middle section of the curved body 2 and allows the patient to rest their torso. The leg section 5 is a lower section of the curved body 2 and allows the patient to rest their legs.

Figure 5:
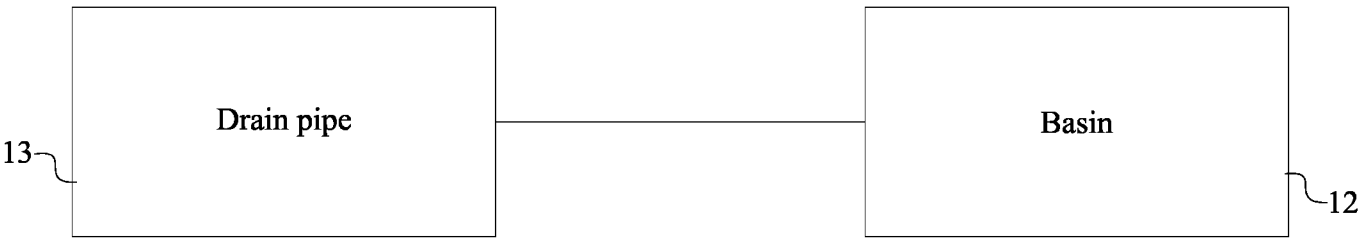
FIG. 5 is a schematic view showing the in fluid communication between the basin and the drainpipe of the present invention.

In reference to FIG. 2 and FIG. 5, the basin 12 is connected into the torso section 4 and positioned in between the pair of hip supports 20 and the handheld bidet system 15. In other words, the basin 12 is designed to align with patient's ischial, sacrum, and perineal areas that generally requires additional cleaning steps. Furthermore, the present invention further comprises a drainpipe 13 that is in fluid communication with the basin 12. The drainpipe 13 discharges graywater from the basin 12 into a proper discharging outlet such as a toilet, a shower drain of a bathroom, or a portable reservoir.

Optionally, the present invention can comprise a flow control valve to control the drainage of graywater from the basin 12. More specifically, the drainpipe 13 and the basin 12 are in fluid communication with each other through the flow control valve so that the caregivers can control the drainage of graywater. For example, when the basin 12 needs to be filled with clean water, the flow control valve can be configured to a closed position thus allowing clean water to collect within the basin 12. When the graywater needs to continuously discharge from the basin 12, the flow control valve can be configured to an opened position.

In reference to FIG. 3-4, the present invention further comprises at least one first locking assembly 23, and the curved body 2 further comprises a first track 6. The first locking assembly 23 is preferably a quick release pin binder clamp so that the caregivers can operate the first locking mechanism between an engaged position and a disengaged position. However, the present invention can utilize any other type of quick release locking mechanism other than the quick release pin binder clamp as the first locking assembly 23. The first track 6 traverses into the head section 3 and positioned across the curved body 2. In other words, the first track 6 is positioned parallel to the top edge 10 and extended across the head section 3. Furthermore, the first locking assembly 23 is operatively coupled to the pair of head supports 19 and the first track 6 so that the pair of head supports 19 can be slidably engaged to the first track 6 via the first locking assembly 23. The pair of head supports 19 can be made from water resistant, comfortable, and foam like material, such as low-resilience polyurethane foam, so that the pair of head supports 19 can be comfortably placed against the patient's head. For example, the first locking assembly 23 is first configured to the disengaged position before the patient is placed within the present invention. Once the patient is placed, the caregivers can adjust and press the pair of head supports 19 against the left side and the right side of the patient's head. The first locking assembly 23 is then configured to the engaged position thus stabilizing the patient's head to the head section 3.

In reference to FIG. 34, the present invention further comprises at least one second locking assembly 24, and the curved body 2 further comprises a second track 7. The second locking assembly 24 is preferably a quick release pin binder clamp so that the caregivers can operate the second locking mechanism between an engaged position and a disengaged position. However, the present invention can utilize any other type of quick release locking mechanism other than the quick release pin binder clamp as the second locking assembly 24. The second track 7 traverses into the torso section 4 and positioned across the curved body 2. In other words, the second track 7 is positioned parallel to the top edge 10 and extended across the torso section 4. Furthermore, the second locking assembly 24 is operatively coupled to the pair of hip supports 20 and the second track 7 so that the pair of hip supports 20 can be slidably engaged to the second track 7 via the second locking assembly 24. The pair of hip supports 20 can be made from water resistant, comfortable, and foam like material, such as low-resilience polyurethane foam, so that the pair of hip supports 20 can be comfortably placed against the patient's hips. For example, the second locking assembly 24 is first configured to the disengaged position before the patient is placed within the present invention. Once the patient is placed, the caregivers can adjust and press the pair of hip supports 20 against the patient's left hip and the right hip. The second locking assembly 24 is then configured to the engaged position thus stabilizing the patient's hips to the torso section 4.

In reference to FIG. 3-4, the present invention further comprises a third locking assembly 25, and the curved body 2 further comprises a third track 8. The third locking assembly 25 is preferably a quick release pin binder clamp so that the caregivers can operate the third locking mechanism between an engaged position and a disengaged position. However, the present invention can utilize any other type of quick release locking mechanism other than the quick release pin binder clamp as the third locking assembly 25. The third track 8 traverses into the leg section 5 and positioned along the curved body 2. In other words, the third track 8 is positioned perpendicular to the top edge 10 and extended along the leg section 5. Furthermore, the third locking assembly 25 is operatively coupled to the left heel support 21 and the third track 8 so that the left heel support 21 can be slidably engaged to the third track 8 via the third locking assembly 25. The left heel support 21 can be made from water resistant, comfortable, rigid, and foam like material, such as low-resilience polyurethane foam, so that the left heel support 21 can be comfortably placed against the patient's left heel. For example, the third locking assembly 25 is first configured to the disengaged position before the patient is placed within the present invention. Once the patient is placed, the caregivers can adjust and press the left heel support 21 against the patient's left heel. The third locking assembly 25 is then configured to the engaged position thus stabilizing the patient's left heel to the leg section 5.

In reference to FIG. 34, the present invention further comprises a fourth locking assembly 26, and the curved body 2 further comprises a fourth track 9. The fourth locking assembly 26 is preferably a quick release pin binder clamp so that the caregivers can operate the fourth locking mechanism between an engaged position and a disengaged position. However, the present invention can utilize any other type of quick release locking mechanism other than the quick release pin binder clamp as the fourth locking assembly 26. The fourth track 9 traverses into the leg section 5 and positioned along the curved body 2. In other words, the fourth track 9 is positioned perpendicular to the top edge 10 and extended along the leg section 5. Furthermore, the fourth locking assembly 26 is operatively coupled to the right heel support 22 and the fourth track 9 so that the right heel support 22 can be slidably engaged to the fourth track 9 via the fourth locking assembly 26. The right heel support 22 can be made from water resistant, comfortable, rigid, and foam like material, such as low-resilience polyurethane foam, so that the right heel support 22 can be comfortably placed against the patient's right heel. For example, the fourth locking assembly 26 is first configured to the disengaged position before the patient is placed within the present invention. Once the patient is placed, the caregivers can adjust and press the right heel support 22 against the patient's right heel. The fourth locking assembly 26 is then configured to the engaged position thus stabilizing the patient's right heel to the leg section 5.

In reference to FIG. 3-4, the present invention further comprises a plurality of back supports 18. More specifically, each of the plurality of back supports 18 is positioned along the torso section 4 and adjacently connected onto the torso section 4. Each of the plurality of back supports 18 is positioned in between the pair of head supports 19 and the pair of hip supports 20 so that the patient's back can be comfortably rest upon the torso section 4. Furthermore, the plurality of back supports 18 also allows graywater to be drain into basin 12 from the head section 3 and eliminates spillage of graywater from the left side and the right side of the curved body 2.

Figure 6:
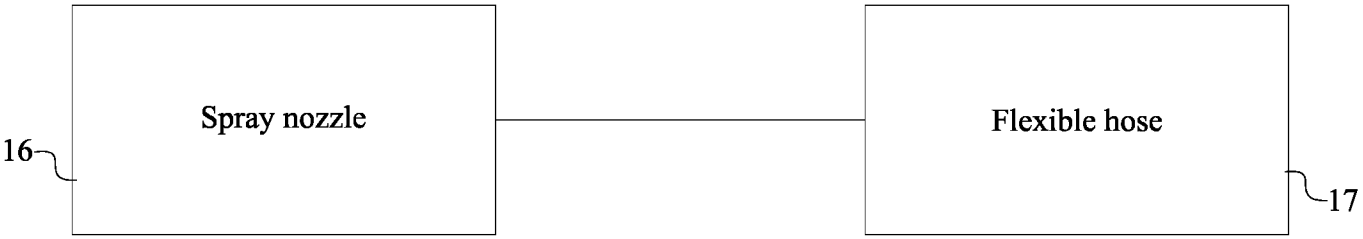
FIG. 6 is a schematic view showing the in fluid communication between the spray nozzle and the flexible hose of the present invention.

In reference to FIG. 2 and FIG. 6, the present invention further comprises a holder 14 so that the handheld bidet system 15 can be removably secured to the curved body 2. The handheld bidet system 15 comprises a spray nozzle 16 and a flexible hose 17 thus providing a source of clean water to the present invention. More specifically, a female end of the flexible hose 17 is attached to an existing waterspout or any other industry standard water outlets thus enabling a flow of clean water to enter into the flexible hose 17. A male end of the flexible hose 17 is in fluid communication with the spray nozzle 16 so that the flow of clean water can be discharged through the spray nozzle 16. The holder 14 is adjacently connected onto the leg section 5 and functions as a placeholder for the spray nozzle 16. More specifically, the flexible hose 17 is radially encircled by the holder 14 as the flexible hose 17 is inserted through the holder 14. As a result, the holder 14 also acts as a guide for the flexible hose 17 while the spray nozzle 16 is removably mounted to the holder 14.

The present invention can also utilize with a stabilizing base structure that can be removably mounted to the platform 1. More specifically, the stabilizing base structure provides a stable platform for the present invention to overcome the curvature of the curved body 2.

Although the invention has been explained in relation to its preferred embodiment, it is to be understood that many other possible modifications and variations can be made without departing from the spirit and scope of the invention as hereinafter claimed.

What is claimed is:

1. A portable cleaning station for physically disabled patients comprising:

a platform;

a handheld bidet system;

at least one pair of head supports;

at least one pair of hip supports;

a left heel support;

a right heel support;

the platform comprising a curved body and a basin;

the basin being integrated into the curved body;

the handheld bidet system being connected into the curved body;

the handheld bidet system being adjacently positioned to a bottom edge of the curved body;

the left heel support being adjustably mounted along the curved body;

the right heel support being adjustably mounted along the curved body;

the pair of head supports being adjustably mounted across the curved body;

the pair of head supports being adjacently positioned to a top edge of the curved body;

the pair of hip supports being adjustably mounted across the curved body; and the pair of hip supports being adjacently positioned to the basin.

2. The portable cleaning station for physically disabled patients as claimed in claim 1 comprising:

the curved body comprising a head section, a torso section, and a leg section;

the head section and the torso section being adjacently connected to each other;

the leg section being adjacently connected to the torso section, opposite of the head section;

the basin being connected into the torso section; and the basin being positioned in between the pair of hip supports and the handheld bidet system.

3. The portable cleaning station for physically disabled patients as claimed in claim 2 comprising:

at least one first locking assembly;

the curved body further comprising a first track;

the first track traversing into the head section;

the first track being positioned across the curved body; and the pair of head supports being slidably engaged to the first track through the first locking assembly.

4. The portable cleaning station for physically disabled patients as claimed in claim 2 comprising:

at least one second locking assembly;

the curved body further comprising a second track;

the second track traversing into the torso section;

the second track being positioned across the curved body; and the pair of hip supports being slidably engaged to the second track through the second locking assembly.

5. The portable cleaning station for physically disabled patients as claimed in claim 2 comprising:

a third locking assembly;

a fourth locking assembly;

the curved body further comprising a third track and a fourth track;

the third track traversing into the leg section;

the fourth track traversing into the leg section;

the third track being positioned along the curved body;

the fourth track being positioned along the curved body;

the left heel support being slidably engaged to the third track through the third locking assembly; and the right heel support being slidably engaged to the fourth track through the fourth locking assembly.

6. The portable cleaning station for physically disabled patients as claimed in claim 2 comprising:

a plurality of back supports;

each of the plurality of back supports being positioned along a torso section of the curved body;

each of the plurality of back supports being adjacently connected onto the torso section; and each of the plurality of back supports being positioned in between the pair of head supports and the pair of hip supports.

7. The portable cleaning station for physically disabled patients as claimed in claim 1 comprising:

a drainpipe; and the drainpipe is in fluid communication with the basin.

8. The portable cleaning station for physically disabled patients as claimed in claim 1 comprising:

a holder;

the handheld bidet system comprising a spray nozzle and a flexible hose;

the holder being adjacently connected onto a leg section of the curved body;

the flexible hose being radially encircled by the holder;

the spray nozzle being removably mounted to the holder; and the spray nozzle being in fluid communication with the flexible hose, wherein a flow of clean water is discharged through the spray nozzle.

* * * * *